US008752459B1

(12) United States Patent
Koresh

(10) Patent No.: US 8,752,459 B1
(45) Date of Patent: Jun. 17, 2014

(54) PORTABLE SAW GUIDE AND METHOD OF USE

(76) Inventor: Melvin R. Koresh, Fenton, MI (US)

( * ) Notice: Subject to any disclaimer, the term of this patent is extended or adjusted under 35 U.S.C. 154(b) by 66 days.

(21) Appl. No.: 13/136,111

(22) Filed: Jul. 22, 2011

Related U.S. Application Data

(63) Continuation-in-part of application No. 12/220,920, filed on Jul. 30, 2008, now abandoned.

(51) Int. Cl.
*B27B 9/04* (2006.01)
*B27B 5/20* (2006.01)

(52) U.S. Cl.
USPC ..... 83/13; 83/471.3; 83/486.1; 83/477.1

(58) Field of Classification Search
USPC ..... 83/468.3, 468.4, 574, 441.1, 454, 83/435.12–435.14, 486.1, 13; 108/77
See application file for complete search history.

(56) References Cited

U.S. PATENT DOCUMENTS

| | | | | | |
|---|---|---|---|---|---|
| 1,700,189 | A * | 1/1929 | Wikstrom | 30/376 |
| 1,997,239 | A * | 4/1935 | Shea | 108/77 |
| 2,630,146 | A | 3/1953 | Tuyl | |
| 2,634,767 | A * | 4/1953 | Chappell | 83/486.1 |
| 2,677,399 | A * | 5/1954 | Getsinger | 83/468.3 |
| 2,803,271 | A | 8/1957 | Shaw | |
| 2,942,633 | A * | 6/1960 | King | 83/745 |
| 3,195,591 | A * | 7/1965 | Haberman | 83/471.2 |
| 3,584,663 | A | 6/1971 | Yacobucci | |
| 3,872,755 | A * | 3/1975 | Marsh et al. | 83/471.3 |
| 4,050,336 | A * | 9/1977 | Stubbings | 83/486.1 |
| 4,224,855 | A * | 9/1980 | Des Roches | 83/745 |
| 4,335,512 | A * | 6/1982 | Sheps et al. | 30/376 |
| 4,522,098 | A * | 6/1985 | Bliss | 83/745 |
| 4,606,279 | A * | 8/1986 | Tucker et al. | 108/78 |
| 5,144,994 | A | 9/1992 | Stecker, Sr. | |
| 5,293,801 | A * | 3/1994 | Dritenbas | 83/468.3 |
| 5,404,779 | A * | 4/1995 | Break | 83/471.3 |
| 5,427,006 | A | 6/1995 | Finley | |
| 6,705,192 | B2 | 3/2004 | Logan | |
| 6,948,539 | B1 * | 9/2005 | Barker et al. | 144/286.5 |
| 6,990,882 | B2 | 1/2006 | Schonfelder | |
| 8,186,257 | B2 * | 5/2012 | Heflin et al. | 83/471 |
| 8,302,518 | B2 * | 11/2012 | Rybka et al. | 83/468.4 |
| 2003/0019404 | A1 * | 1/2003 | Liu | 108/77 |
| 2003/0097920 | A1 | 5/2003 | Ransom et al. | |
| 2005/0016631 | A1 * | 1/2005 | Zhang | 144/286.5 |
| 2006/0201299 | A1 * | 9/2006 | Santa Ana | 83/468.3 |

* cited by examiner

*Primary Examiner* — Laura M Lee
(74) *Attorney, Agent, or Firm* — Albert W. Davis, Jr.

(57) ABSTRACT

The invention provides a portable folding saw guide for hand held circular saws that allow the user to make different cross angled cuts to a work piece positioned thereon. The guide uses an adjustable guide track in which the saw is engaged which can be sequentially positioned at different cross angle incremental orientation by the user in a self-contained portable platform structure. The saw guide has hinges that allow the bottom surface of one of the work surface portions to be folded up against the bottom surface of the other work surface portion so that the saw guide can be folded, transported to a use location, unfolded and used. The saw guide plate supports and engages the saw on one side of the saw only.

5 Claims, 8 Drawing Sheets

PORTABLE SAW GUIDE AND METHOD OF USE

This is a Continuation in Part of patent application Ser. No. 12/220,920, filed Jul. 30, 2008 now abandoned.

BACKGROUND OF THE INVENTION

1. Technical Field

This invention relates to saw tables and saw guides used with handheld circular saws to provide an adjustable guide edge surface for making straight or angled cuts in wood or related material.

2. Description of Prior Art

Prior art devices of this type have been relied a variety of different guide configurations which allows a handheld circular power saw to cut clean straight edges along an angled cut line. Such guides typically have a guide plate along which the edge of the power saw is engaged and drawn. Such devices can be seen in U.S. Pat. Nos. 5,144,994, 5,427,006, 2,630,146, 2,803,271 6,705,192 B2, 6,990,882 B2, 3,195,591, 3,584,663 and U.S. Publication 2003/0097920 A1.

In U.S. Pat. No. 2,630,146 a portable power tool guide is disclosed having a post with a sliding vertical adjustable collar from which extends a saw supporting frame.

U.S. Pat. No. 2,803,271 discloses a miter table saw guide having a pivoted saw support bracket allowing for angular cross cuts of material on the support table.

In U.S. Pat. No. 5,144,994 a portable universal saw table having parallel rails with multiple transverse removable cross pieces.

U.S. Pat. No. 5,427,006 is directed to a circular saw guide for handheld circular saws having a slotted elongated track through which the saw is engaged. A floating frame aligns the work piece for cutting with the track being pushed down and adjustably angled before the cut is made.

A folding table saw is claimed in U.S. Pat. No. 6,705,192 B2 having a collapsible table with folding support legs and a saw track assembly adjustably positioned thereon. A lower platform supports the work piece to be cut and an upper platform on which the saw is slidably positioned.

U.S. Pat. No. 6,990,882 B2 discloses a precision cut device for construction material having a saw table with an adjustable saw cradle slidably mounted thereto.

U.S. Pat. No. 3,195,591 claims a portable saw table having saw guide positioned above a work table with wheels and a pivot pin allowing for angular repositioning of the guide.

U.S. Pat. No. 3,584,663 shows a support and guide means for saws having a parallelogram linkage pivotally mounted to an upstanding wall.

U.S. Publication 2003/0097920 A1 claims a portable saw with linear guides allowing for saw fence to be adjusted to different angles. The table can be folded for transportation to other locations.

SUMMARY OF THE INVENTION

A portable saw guide for positioning on a support surface has a material alignment and support surface with an elevated adjustable saw engagement track there across. The guide track is pivoted with multiple interengaging angular locking positions on a curvilinear edged extending support surface portion.

DETAILED DESCRIPTION OF THE PREFERRED EMBODIMENT

Figure 1:
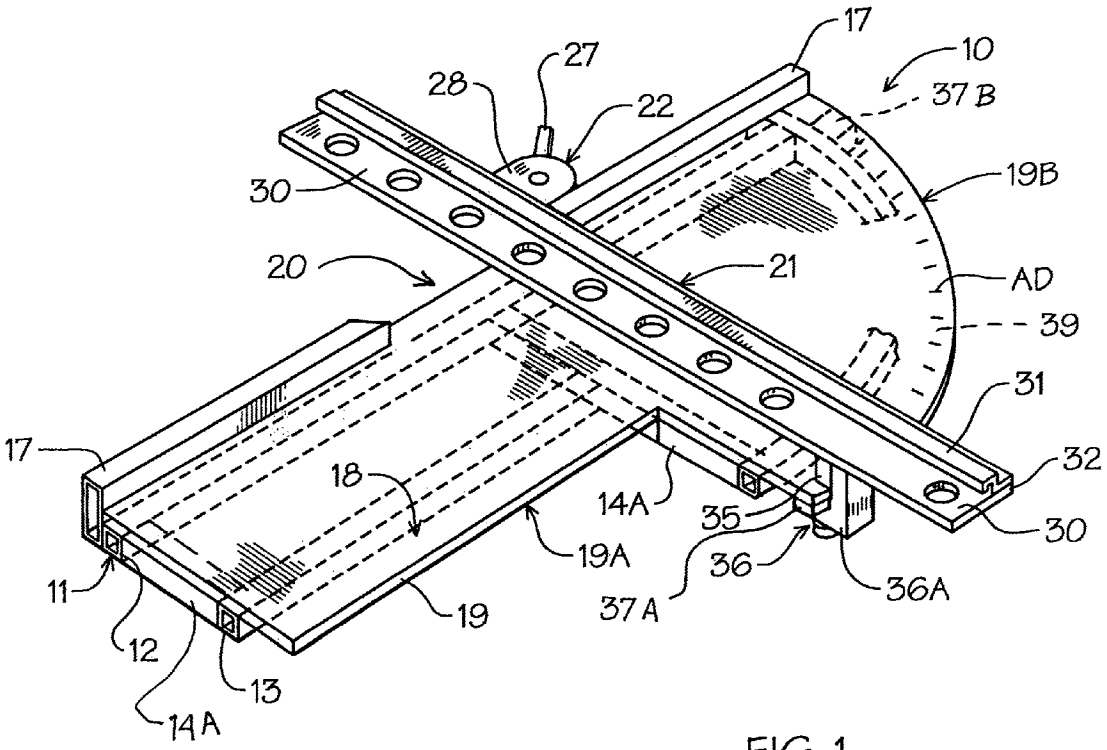
FIG. 1 is a perspective top-side end view of the saw guide of the invention.
Figure 2A:
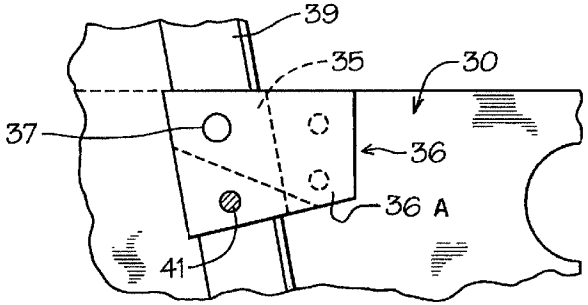
FIG. 2A is an enlarged partial bottom plan view of an indexing assembly.
Figure 2:
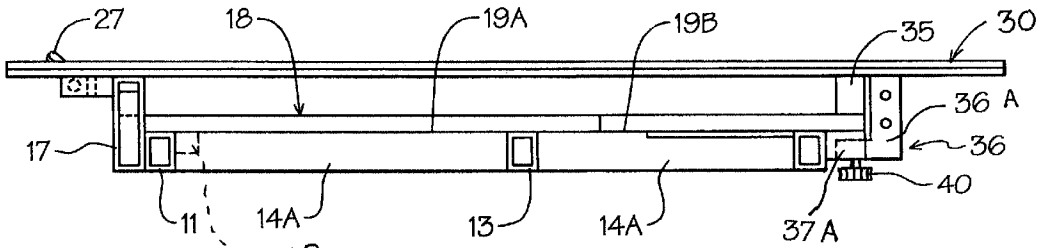
FIG. 2 is an end elevational view thereof.
Figure 3:
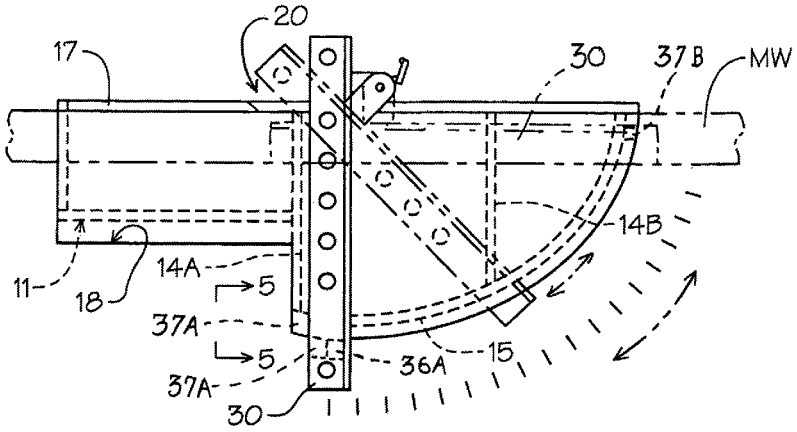
FIG. 3 is a top plan view thereof.

Referring to FIGS. 1, 2 and 3 of the drawings, a saw guide 10 of the invention can be seen having a tubular base frame 11 with parallel main support members 12-13, interconnecting cross support members 14 A-B and an arcuate frame member 15 extending from the support member 12 and intersecting as seen in dotted lines in FIG. 3 of the drawings. A fence 17 is secured to the support member 12 extending there above. A material work surface 18 is formed from a synthetic resin top panel 19 having a rectangular portion 19 A and a half arcuate portion 19 B which is secured respectively to the corresponding tubular support members 12, 13, 14, and 15 defining the work surface 18.

The fence 17 extends above the planar surface of the work surface 18 and has an access opening at 20 therein as will be described in greater detail hereinafter.

Figure 7:
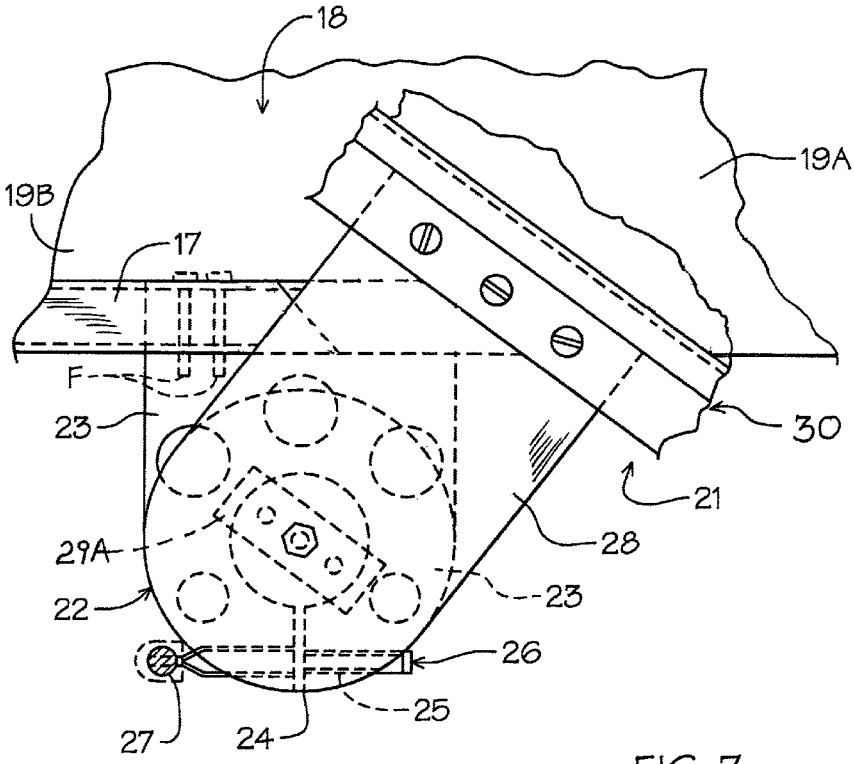
FIG. 7 is an enlarged partial top plan view.

A saw track assembly 21 extends during use transversely across the work surface 18 of the arcuate panel portion 19B. The saw track assembly 21 has a main pivot support mount 22, best seen in FIGS. 3, 4 and 7 of the drawings having an aperture base plate 23 with a compression slit extending outwardly at 24. A trans-circumferal bore at 25 extends therethrough for mounting a threaded compression pin assembly 26 with a crank handle pin assembly 27 on the end thereof as will be well understood by those skilled in the art.

Figure 4:
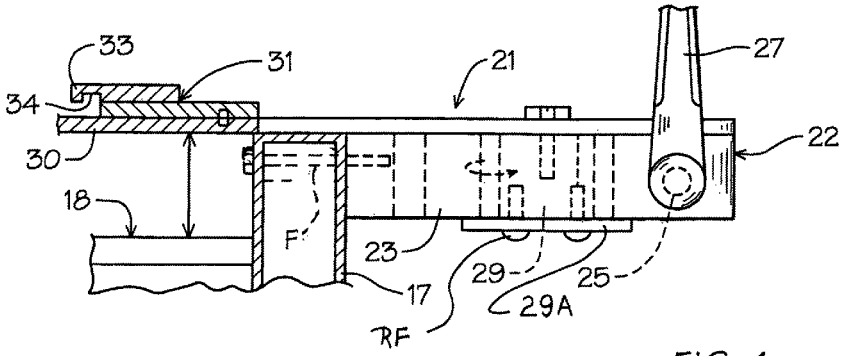
FIG. 4 is an enlarged partial end sectional elevational view thereof in non-use position.

Accordingly, the base plate 23 is secured by multiple fasteners F to the fence tube 17 with a pivot plate 28 extending therefrom overlying the fence tube 17 as best seen in FIG. 4 of the drawings. The pivot plate 28 has a pivot bearing 29 which is registerable with the aperture of the base plate 23 with a retainment plate 29A secured thereto by fasteners RF.

Figure 5:
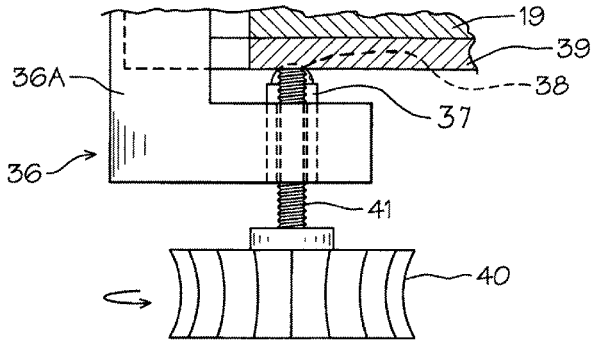
FIG. 5 is an enlarged partial sectional view on lines 5-5 of FIG. 3.
Figure 6:
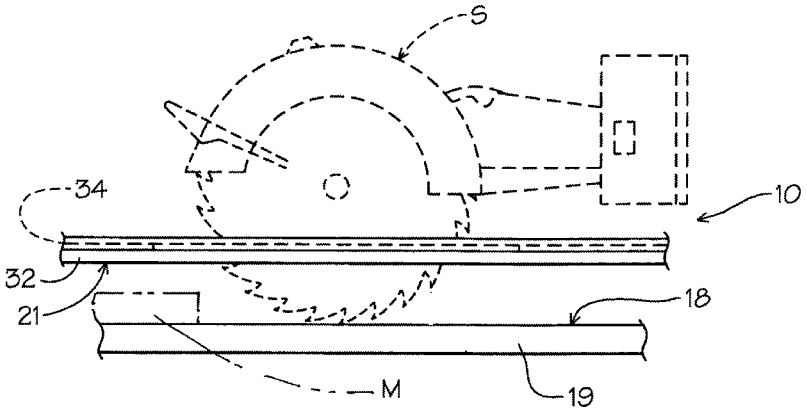
FIG. 6 is an enlarged partial end view of the guide track with a saw positioned thereon shown in broken lines.

It will be evident that by compression of the base plate via the compression pin 26 the pivot plate 28 will selectively be secured in any angularly annular orientation therewith. A guide plate 30 is secured to the free end of the pivot plate 28 having elongated generally flat saw support surface with an upturned saw engagement flange 31 extending along its perimeter edge 32 adjacent the guide plate 30 attachment. The saw engagement flange 31, as best seen in FIG. 4 of the drawings has a downturned flange 33 forming a converted channel 34 into which a portion of the hand held circular saw S, shown in broken lines in FIG. 6 of the drawings, is engaged during use providing a straight guide edge therealong. The guide plate 30 is supported in vertical spaced relation across the work surface 18 by a spacer block 35 slidably engaged thereon and secured to an angular indexing assembly 36 extending from the underside of the guide plate 30 inwardly of its free end. The angle indexing assembly 36 has a main L-shaped depending flange 36A which returns under the arcuate edge of the support work surface 18. A resilient indexing ball fitting 37 is positioned therein and selectively registers in spaced aligned detents 38 formed within an indexing plate 39, best seen in FIG. 5 of the drawings secured to the underside of the top panel arcuate portion 19B.

It will be seen that the detents 38 correspondingly align to the angular arcuate degrees AD indicating the orientation of the guide plate to the fence 17, thus providing multiple repositionable angular cutting guide positions to a work piece on the work surface 18 aligned with the guide fence 17.

In operation, the guide plate 30 can be positioned from a ninety degree transverse oriented position across the work surface 18 shown in solid lines in FIG. 3 through multiple cross angular orientation inclinations corresponding to the arcuate degrees therefrom sequentially shown in broken lines in FIG. 3 of the drawings.

As the guide plate 30 is pivoted, it selectively engages the indexing ball fitting 37 with the corresponding aligned detents 38. A locking knob 40 is provided having a threadably advanced shaft 41 extending upwardly through the hereinbefore described mounting flange against the indexing plate 39 which is engageable between the aforedescribed detents 38 to selectively secure and lock the guide plate 30 in the determined angular selected position. Guide plate stops 37A and 37B are secured to the underside of the work surface 18 so as to engage the depending flange 36A defining a range of adjustment.

The hand powered circular saw S is then slid into the guide channel 34 resting on the guide plate 30 with the saw blade B extending downwardly there beyond spaced for material M engagement on the work surface 18 when so positioned as will be understood by those skilled in the art.

This arrangement allows for precise angular cutting and a portable self-contained saw guide that can be easily transported to use location venues.

Figure 8:
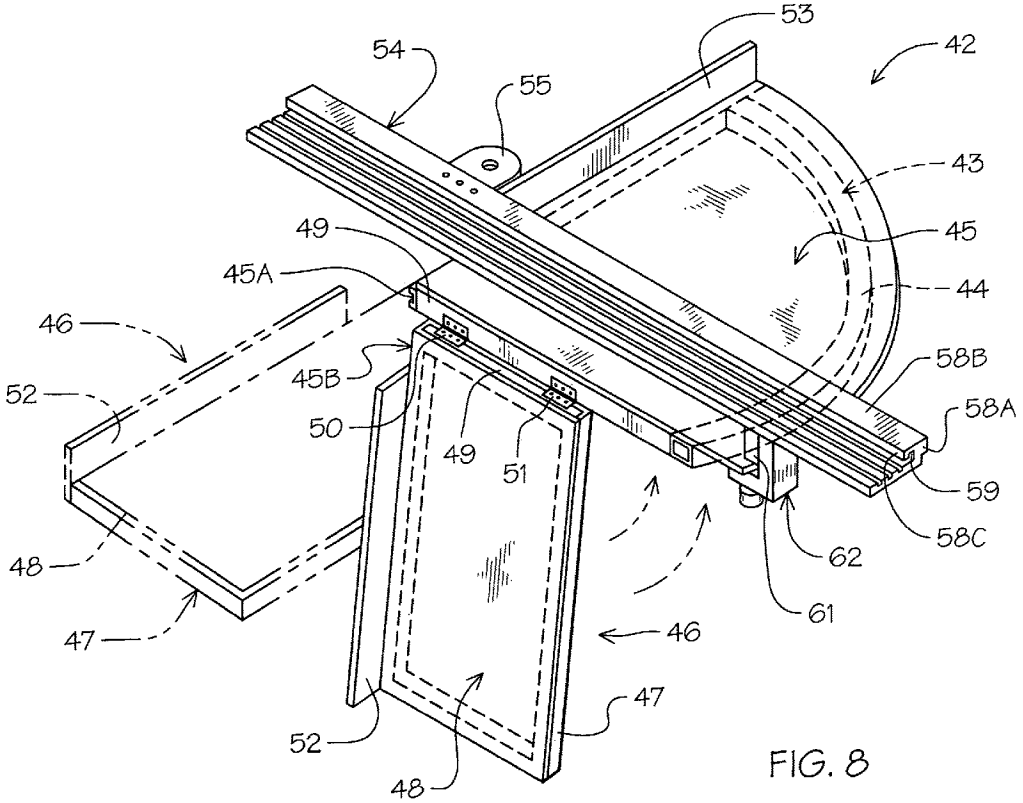
FIG. 8 is a perspective top side end view of an alternate improved form of the invention with a hinged table configuration.

Referring to FIG. 8 of the drawings an alternate improved form of the invention can be seen wherein a folding saw guide 42 having a tubular base frame 43 with an arcuate frame portion 44 supporting a half-arcuate top work surface panel 45 thereon. An extension portion 46 has a rectangular tubular support frame 47 with a corresponding work surface panel 48 secured thereto. The extension portion 46 is hinged to the arcuate frame portion 44 along the parallel transverse edges 49 by hinges 50 and 51. Material engagement upstanding fence extrusions 52 and 53 are secured along the respective longitudinally aligned edge portions 45A and 45B of the extension portion 46 and arcuate frame portion 44, respectively.

Figure 9:
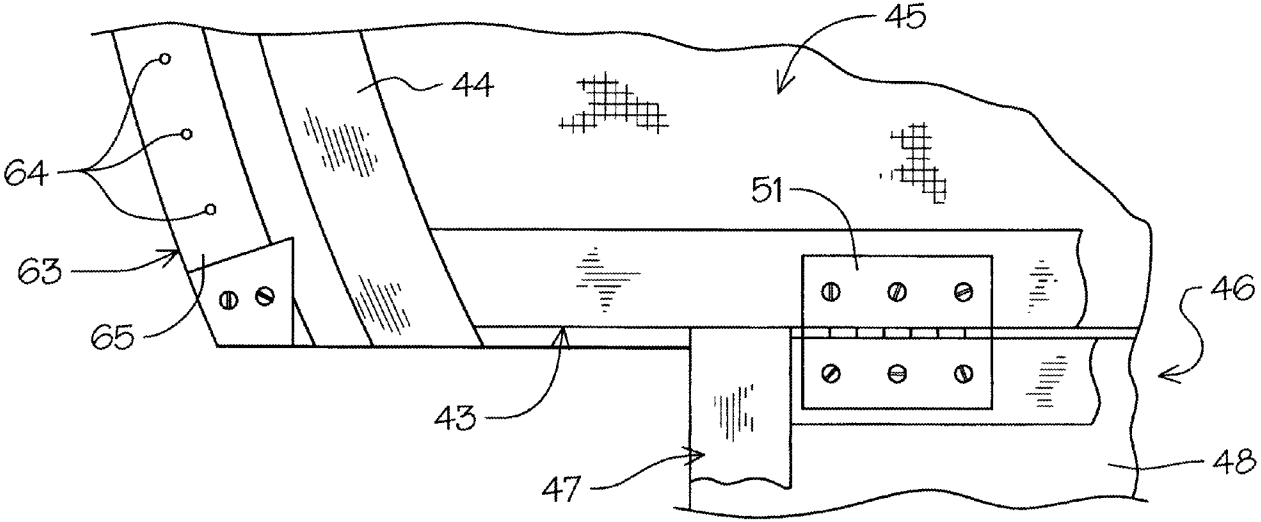
FIG. 9 is an enlarged partial bottom plan view of the hinge end indexing assembly.
Figure 10:
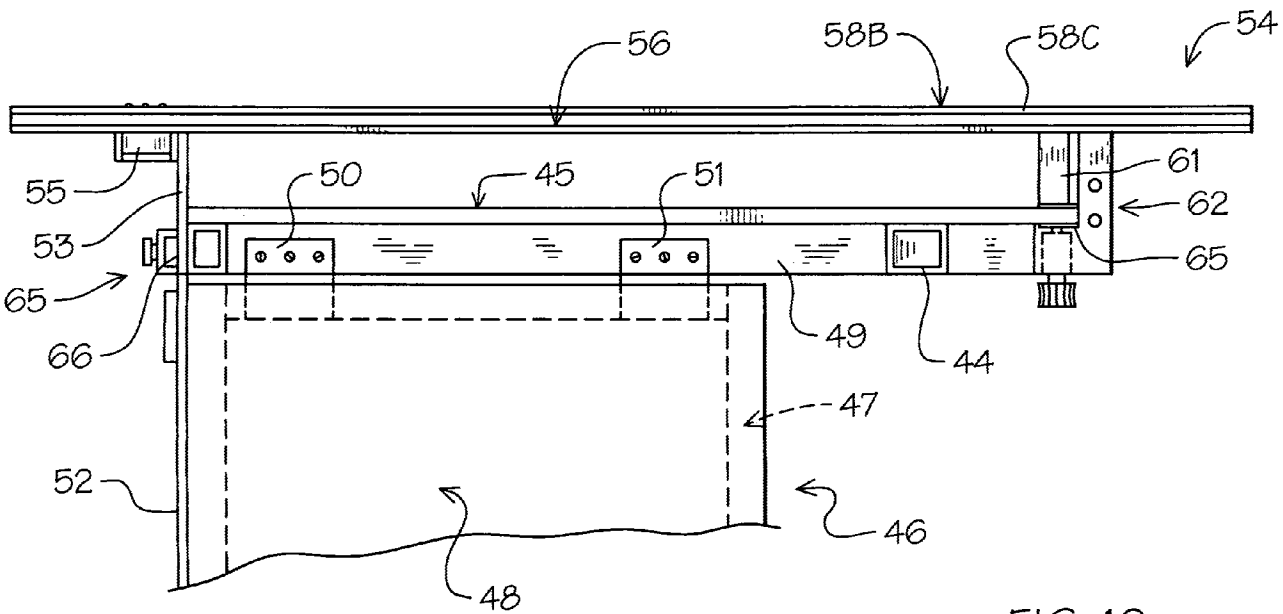
FIG. 10 is an end elevated view with the hinged table portion dropped down.

A saw track receiving assembly 54 extends during use transversely across the arcuate top work surface panel 45 allowing a saw to be selectively and slidably engaged therein. A saw track assembly 54 has a main pivot support mount 55 similar to that of the mount 22 hereinbefore described in the primary form of the invention. The saw track assembly 54 has an elongated saw receiving guide plate 56 secured to the pivoted support mount 55 defining a flat support surface track 57 having a compound flange 58 extending along one edge thereof. The compound flange 58 comprises an upturned flange portion 58A, horizontal return portion therefrom 58B and a downturned flange portion extending therefrom 58C which forms a receiving and retainment inverted channel 59 therein. The saw receiving guide plate 55 is supported in vertical spaced relation across the arcuate top work surface panel 45 by the hereinbefore disclosed pivot support mount and an end spacer block 61 and indexing assembly 62 that extends from under the arcuate edge of the work surface panel 45. The indexing assembly 62 is the same as that on the hereinbefore described indexing assembly 36 and allows for selective angular indexing retention of the saw receiving guide plate 55 along the arcuate edge 63 of the half-arcuate work surface 45. By engagement with spacing indexing detents 64 in an arcuate indexing band 65 secured to the bottom edge thereof as seen in FIG. 9 of the drawings.

The hinges 51 and 52 allow the extension portion 46 to fold downwardly and up against the bottom of the arcuate portion 44 for storage and transportation as shown in broken, solid and directional broken arrow lines.

A slide lock latch assembly 65 is secured along the outer edges 66 of both the work surface portions 45 and 44 on either side of the defined hinge area between the respective work surfaces hereinbefore described so as to secure same in open co-planar work engagement position during use.

It will thus be seen that a new and novel portable self-contained folding saw guide has been illustrated and described and it will be apparent to those skilled in the art that various changes and modifications may be made thereto without departing from the spirit of the invention.

Therefore I claim:

1. A method of using a portable folding saw guide for use with a circular saw for cutting a work piece in pre-described cross cut comprises, providing an arcuate saw guide plate engagement work surface portion being formed by an arcuate edge forming a 90 degree arc and two straight edge portions and a co-planar material work surface portion hinged to and extending therefrom, each work surface portion having a top surface and an bottom surface, an upstanding fence extending along a portion of one edge of each of said respective work surface portions, the fences being aligned, the arcuate edge extending from the fence on the arcuate saw guide plate engagement work surface portion in a 90 degree arc, a saw guide plate pivotally secured adjacent to and adjustably positioned across said arcuate saw guide plate engagement work surface in vertically spaced relation thereto, the hinges allowing the bottom surface of one of the work surface portions to be folded up against the bottom surface of the other work surface portion, folding the bottom surface of one of the work surface portions up against the bottom surface of the other work surface portion, transporting the saw guide to a use location, unfolding the saw guide and sawing using the saw guide.

2. The method of using a portable folding saw guide set forth in claim 1 wherein said respective upstanding fences are in longitudinally spaced alignment with one another during use.

3. The method of using a portable folding saw guide set forth in claim 1 wherein said arcuate saw guide plate engagement work surface portion has a sliding lock bar selectively engaged therefrom for registration with said co-planar material work surface portion.

4. The method of using a portable folding saw guide set forth in claim 1 wherein said pivotally secured saw guide plate has a pivot support mount horizontally offset thereto and spaced inwardly from one end thereof.

5. The method of using a portable folding saw guide set forth in claim 1 wherein said hinged material work surface portion is selectively positioned from a first co-planar work surface extension in use position to a second storage and transport position below said arcuate work surface in registration therewith.

* * * * *